US009233554B2

(12) United States Patent
Omoto et al.

(10) Patent No.: US 9,233,554 B2
(45) Date of Patent: Jan. 12, 2016

(54) CONTROL DEVICE, PRINTER, AND CONTROL METHOD OF A PRINTER

(71) Applicant: SEIKO EPSON CORPORATION, Tokyo (JP)

(72) Inventors: Satoshi Omoto, Matsumoto (JP); Satoshi Nakajima, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/495,893

(22) Filed: Sep. 25, 2014

(65) Prior Publication Data

US 2015/0085054 A1 Mar. 26, 2015

(30) Foreign Application Priority Data

Sep. 26, 2013 (JP) ..... 2013-199501

(51) Int. Cl.
*B41J 2/15* (2006.01)
*B41J 2/36* (2006.01)

(52) U.S. Cl.
CPC ..... *B41J 2/36* (2013.01)

(58) Field of Classification Search
CPC ..... B41J 2/0451; B41J 2/2146; B41J 2/01; B41J 2/2139; B41J 2/0458; B41J 2/21; B41J 2/2135; B41J 2/04541; B41J 2/07; B41J 2/2114; B41J 2/13; B41J 2/211; B41J 2/355

See application file for complete search history.

(56) References Cited

U.S. PATENT DOCUMENTS

| | | | | |
|---|---|---|---|---|
| 4,827,286 | A | 5/1989 | Sukigara et al. | |
| 8,757,756 | B2 * | 6/2014 | Ashida | B41J 2/04505 347/14 |
| 8,894,174 | B2 * | 11/2014 | Sethne | B41J 2/2132 347/14 |
| 9,022,514 | B2 * | 5/2015 | Fujisawa | B41J 11/002 347/102 |
| 2011/0242256 | A1 | 10/2011 | Matsutani | |

FOREIGN PATENT DOCUMENTS

| | | | |
|---|---|---|---|
| JP | 63166566 | A | 7/1988 |
| JP | 4146158 | A | 5/1992 |
| JP | 5261959 | A | 10/1993 |
| JP | 2011213017 | A | 10/2011 |

* cited by examiner

*Primary Examiner* — Lamson Nguyen
(74) *Attorney, Agent, or Firm* — Hauptman Ham, LLP

(57) ABSTRACT

When printing a first line, a control device controls energizing heat elements corresponding to pixels where a dot is formed on a second line that is printed continuously. A control device of a thermal head having a plurality of heat elements arranged in a line includes: an acquisition unit that acquires information of pixels forming dots when printing the second line during line printing of a first line and a second line by continuous line printing by the plural heat elements; and an energization control unit that controls energizing the heat elements during the first energizing period based on image data related to printing the first line when printing the first line, and controls energizing the heat elements in the second energizing period when printing the first line based on the image data related to printing the first line and the pixel information acquired by the acquisition unit.

13 Claims, 8 Drawing Sheets

CONTROL DEVICE, PRINTER, AND CONTROL METHOD OF A PRINTER

Priority is claimed under 35 U.S.C. §119 to Japanese Application No. 2013-199501 filed on Sep. 26, 2013, which is hereby incorporated by reference in its entirety.

BACKGROUND

1. Technical Field

The present disclosure relates to a control device, a printer, and a control method of a printer.

2. Related Art

The density of characters printed on recording paper (thermal paper) in a thermal printer differs according to the amount of heat energy applied by the heat elements, and the result of printing may therefore vary according to whether or not a heat element used to print a character was driven immediately before printing the character. To avoid this problem and improve print quality, JP-A-H04-146158 teaches using hysteresis control, a method of storing a history of previous printed pixel data and determining how to energize the heat elements based on the stored history.

However, the method disclosed in JP-A-H04-146158 refers to the past energizing history of the heat elements, and only determines the energizing time of the heat elements used to print next. The image data of the line following the next line to be printed is therefore not considered when printing line by line.

SUMMARY

When printing a first line, a control device, a printer, and a control method of a printer according to at least one embodiment of the present invention can control energizing the heat elements corresponding to the pixels forming dots printed on a second line that is printed continuously after printing the first line.

A control device according to one aspect of at least one embodiment of the present invention is a control device of a thermal head having a plurality of heat elements arranged in a line, including: an acquisition unit that acquires information of pixels forming dots when printing a second line during line printing of a first line and the second line by continuous line printing by the plural heat elements, a printing period of the first line including a first energizing period and a second energizing period; and an energization control unit that controls energizing the heat elements during the first energizing period based on image data related to printing the first line, and controls energizing the heat elements in the second energizing period based on the image data related to printing the first line and the pixel information acquired by the acquisition unit.

When printing a first line, the control device thus comprised controls energizing the heat elements that are to form dots on the first line in the first energizing period of the printing period, and during the second energizing period of the printing period controls energizing the heat elements corresponding to pixels that form dots when printing the second line sufficiently to preheat the heat elements for printing the second line. When printing the first line, the heat output of the heat elements corresponding to the pixels where a dot is formed when printing the second line can be increased. As a result, a drop in print quality due to the temperature of the heat element being low when printing and the formed dot being small or light can therefore be suppressed.

In a control device according to another aspect of at least one embodiment of the present invention, the second energizing period is less than or equal to ½ the first energizing period. The control device thus comprised can control a heat element to not form a dot in the second energizing period when printing the first line and a dot can be formed in the first energizing period. In a control device according to another aspect of at least one embodiment of the present invention, the acquisition unit references image data related to printing the second line and acquires information of a pixel forming a dot when printing the second line during line printing by the plural heat elements; and the energization control unit applies dot-forming energization that forms dots to the heat elements based on the image data related to printing the first line in the first energizing period, and applies read-ahead energization to the heat elements in the second energizing period after the dot-forming energization.

When printing the first line, the control device thus comprised applies dot-forming energization for forming dots to the heat elements that should form a dot on the first line, and applies read-ahead energization for increasing the heat output of the heat elements corresponding to the pixels that form a dot on the second line. The heat output of the heat elements corresponding to the pixels where a dot is formed on the second line can therefore be increased when printing the first line. As a result, a drop in print quality due to the temperature of the heat element being low when printing and the formed dot being small or light can therefore be suppressed.

In a control device according to another aspect of at least one embodiment of the present invention, the dot-forming energization is energizing of an amount that forms a dot; and the read-ahead energization is energizing of an amount that increases heat output without forming a dot.

When printing the first line, the control device according to this aspect of at least one embodiment of the present invention can increase the heat output of the heat elements corresponding to pixels that are to form dots on the second line without forming a dot on the first line. As a result, a drop in print quality due to the temperature of the heat element being low when printing and the formed dot being small or light can therefore be suppressed.

In a control device according to another aspect of at least one embodiment of the present invention, the energization control unit controls how much the heat element is energized by the energizing time, and the energizing time of read-ahead energization is shorter than the energizing time of the dot-forming energization.

The control device thus comprised controls energizing the heat elements by controlling the energizing time, and can therefore easily control energization of the heat elements. Because the energizing time of the read-ahead energization is shorter than the energizing time of the dot-forming energization, the heat output of dots to which read-ahead energization is applied is less than the heat output resulting from dot-forming energization. The heat elements that are energized by read-ahead energization can therefore be heated to a lower temperature than the temperature reached by dot-forming energization.

In a control device according to another aspect of at least one embodiment of the present invention, based on image data related to printing the second line, the energization control unit energizes by read-ahead energization the heat elements that form a dot and form a black image on the second line, and does not energize by read-ahead energization the heat elements that do not form a dot and form a white image on the second line.

While printing the first line, the control device according to this aspect of at least one embodiment of the present invention can energize heat elements that form a dot and form a black image when printing the second line. As a result, a drop in print quality due to the temperature of the heat element being low when printing and the formed dot being small or light can therefore be suppressed.

Another aspect of at least one embodiment of the present invention is a printer including the control device described above, and a thermal head having a plurality of heat elements arranged in a line.

When printing a first line, the printer thus comprised controls energizing the heat elements that are to form dots on the first line in the first energizing period of the printing period, and during the second energizing period of the printing period controls energizing the heat elements corresponding to pixels that form dots when printing the second line sufficiently to preheat the heat elements for printing the second line. When printing the first line, the heat output of the heat elements corresponding to the pixels where a dot is formed when printing the second line can be increased. As a result, a drop in print quality due to the temperature of the heat element being low when printing and the formed dot being small or light can therefore be suppressed.

Another aspect of at least one embodiment of the present invention is a control method of a printer that is a control device of a thermal head having a plurality of heat elements arranged in a line, the control method including: acquiring information of pixels forming dots when printing a second line during line printing of a first line and the second line by continuous line printing by the plural heat elements, a printing period of the first line including a first energizing period and a second energizing period; and controlling energizing the heat elements in the first energizing period based on image data related to printing the first line, and controlling energizing the heat elements in the second energizing period based on the image data related to printing the first line and the acquired pixel information.

Other objects and attainments together with a fuller understanding of the invention will become apparent and appreciated by referring to the following description and claims taken in conjunction with the accompanying drawings.

DESCRIPTION OF EMBODIMENTS

Some embodiments of the present invention is described below with reference to the accompanying figures.

Figure 1:
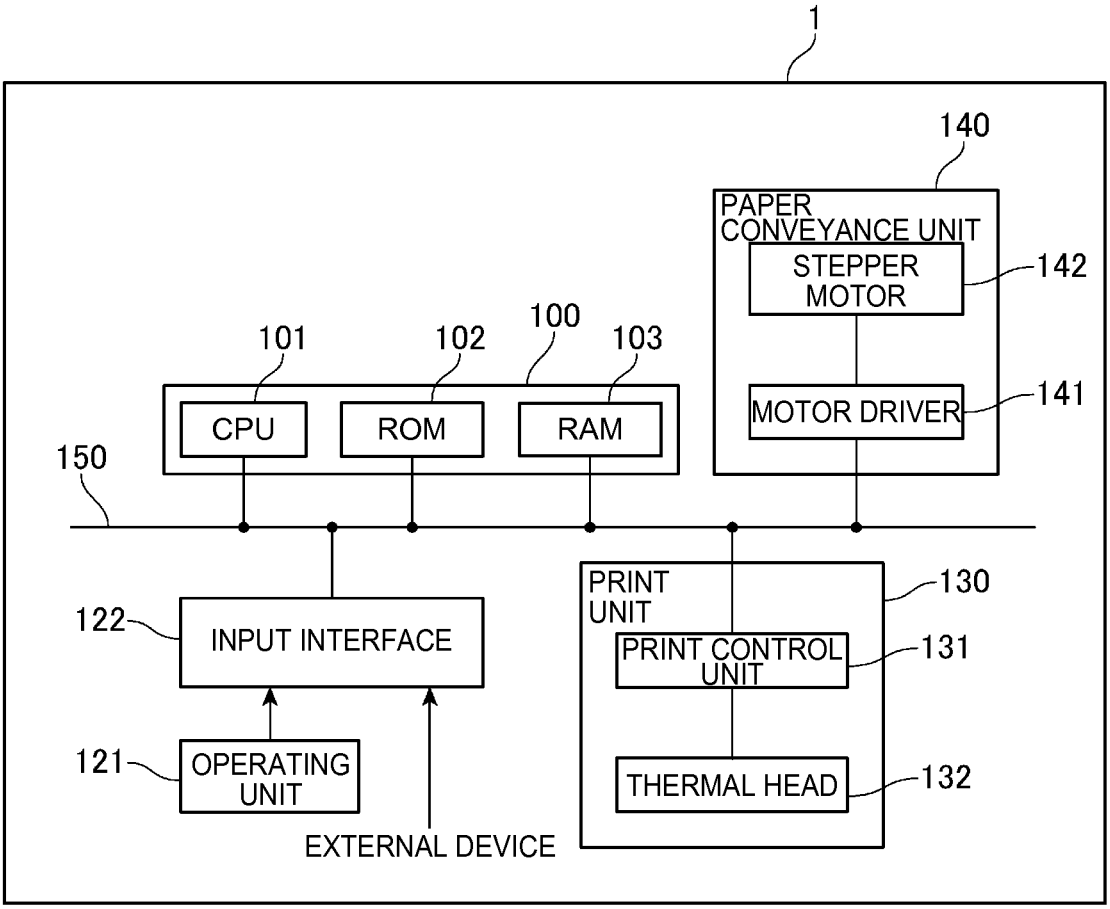
FIG. 1 is a block diagram of an exemplary configuration of a thermal printer.

FIG. 1 shows an example of the configuration of a thermal printer 1 according to some embodiments of the invention. The thermal printer 1 includes a control device 100 and a print unit 130. The control device 100 includes a CPU (central processing unit) 101, ROM (read-only memory) 102, and RAM (random access memory) 103. The CPU 101, ROM 102, and RAM 103 are connected to a system bus 150.

The ROM 102 may be flash memory, for example, and is nonvolatile memory for storing control programs and data used for controlling the thermal printer 1. The CPU 101 reads the control program from ROM 102 and stores the control program in RAM 103. The CPU 101 then runs processes (operations) according to the control programs stored in RAM 103. The processes (operations) run by the CPU 101 are described in detail below.

The RAM 103 in this embodiment is SRAM (static random access memory) or other type of volatile memory, and is used as working memory to temporarily store data to be printed, for example. For example, the CPU 101 receives picture data input from an external device through the input interface 122, and converts the acquired picture data to binary image data.

Image data as used herein is data used to print an actual image on recording paper, and means binary data representing the position of a dot. Note that the picture data sent from an external device, and the image data converted from the picture data, are both image data according to at least one embodiment of the present invention. The CPU 101 renders the converted binary image data to an image buffer reserved in RAM 103.

To print the image data on recording paper, the CPU 101 then reads the image data rendered in the image buffer one line at a time. The CPU 101 generates a data signal D based on the read image data, and outputs the data signal D to the print unit 130. The method of generating the data signal D from the image data is described below. Note that the function blocks embodied by the cooperation of hardware such as the CPU 101 and RAM 103, and a control program, are described below with reference to FIG. 3.

The thermal printer 1 also has an operating unit 121 and an input interface 122. The input interface 122 connects to the operating unit 121 and system bus 150, and to external devices (not shown in the figure) such as a personal computer and scanner. Operating buttons such as the power switch of the thermal printer 1 and buttons for starting and stopping printing are disposed to the operating unit 121, and receive operating input from the user. The operating information received by the operating unit 121 is sent through the input interface 122 to the control device 100. The input interface 122 sends image data input from an external device to the control device 100.

The print unit 130 includes the print control unit 131 and the thermal head 132. The print control unit 131 is connected to the control device 100 through the system bus 150. The print control unit 131 is connected to the control device 100, and outputs control signals for controlling the thermal head 132 to the thermal head 132. As further described below, the control signals include the data signal D, a clock signal CLK, a latch signal LAT, and a strobe signal STB. More specifically, the data signal D, clock signal CLK, latch signal LAT, and strobe signal STB are collectively referred to as control signals.

Figure 2:
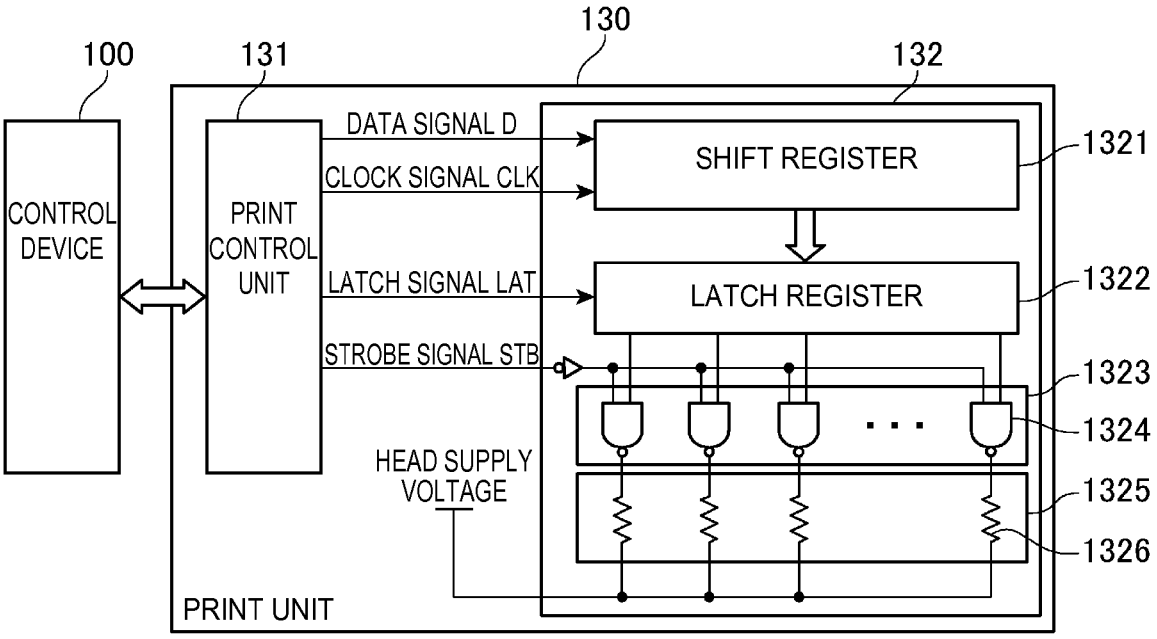
FIG. 2 illustrates the configuration of a thermal head.

An example of the detailed configuration of the thermal head 132, and the control signals sent from the print control unit 131 to the thermal head 132, are described next with reference to FIG. 2.

The thermal head 132 includes a shift register 1321, a latch register 1322, a switch circuit 1323, and a printhead unit 1325.

The data signal D and clock signal CLK from the print control unit 131 are input to the shift register 1321. Data signals D for one line (one printed line) are input synchronized to the clock signal CLK, and the shift register 1321 stores the input data signals D. The clock signal CLK is a signal marking the timing for the thermal head 132 to receive a data signal D. A data signal D includes signals corresponding to each pixel to be printed, and is a signal that is active when the signal level is low, for example.

The latch register 1322 is connected parallel to the shift register 1321. The latch register 1322 concurrently transfers and stores the data signals D stored in the shift register 1321 to a corresponding storage area. The timing of data transfers from the shift register 1321 to the latch register 1322 is controlled by the input timing of the latch signal LAT output from the print control unit 131 to the latch register 1322. The latch signal LAT is a signal that reports the transfer timing of the data signal D from the shift register 1321 to the latch register 1322.

The switch circuit 1323 has a plurality of NAND gates 1324 corresponding to the individual heat elements 1326 of the printhead unit 1325. The data signals D output from the latch register 1322 are input in parallel to one input terminal of the corresponding NAND gates 1324. The data signal D input to each NAND gate 1324 is a signal corresponding to each pixel that forms a dot.

A strobe signal STB common to each NAND gate 1324 is input to the other input terminal of each NAND gate 1324. A strobe signal STB is a signal controlling the energizing time of the heat elements 1326 of the printhead unit 1325. When the signal level of the strobe signal STB is in the active state, the corresponding heat element 1326 is energized and heats if the signal level of the data signal D is also active.

The NAND gates 1324 of the switch circuit 1323 perform a NAND operation on the data signals D parallel input from the latch register 1322 and a signal obtained by a NOT operation on the strobe signal STB. The results from the NAND gates 1324 are output to the printhead unit 1325.

The printhead unit 1325 has numerous heat elements 1326 (resistors) for simultaneously printing one line of image data.

Note that the direction of the line in which the plural heat elements 1326 are arrayed is referred to below as the line direction.

The heat elements 1326 are disposed to the distal end of the printhead unit 1325, which extends across the width of the recording paper used as the recording medium, and one line of dots is formed simultaneously on the recording paper, which is thermal paper in this embodiment, by selectively driving and heating the heat elements 1326. Plural lines of dots are printed on the recording paper by continuously printing one line at a time in line units while moving the recording paper in the direction perpendicular to the line direction. The operation of driving the thermal head 132 and printing an image in line units one at a time is called line printing. The time required to form one line of an image in line printing is called the printing period. The NAND gates 1324, that is, the plural drive circuits for independently driving and heating the individual heat elements 1326, are connected to the corresponding individual heat elements 1326.

Referring again to FIG. 1, the configuration of the thermal printer 1 is further described below. The thermal printer 1 has a paper conveyance unit 140. The paper conveyance unit 140 is a function unit that conveys the recording paper, and includes a motor driver 141 and a stepper motor 142.

The motor driver 141 controls driving the stepper motor 142 as controlled by the control device 100. The stepper motor 142 rotationally drives the paper feed roller (not shown in the figure) as controlled by the motor driver 141. The recording paper that is line printed by the thermal head 132 is conveyed by rotation of the paper feed roller to the next line to print.

Figure 3:
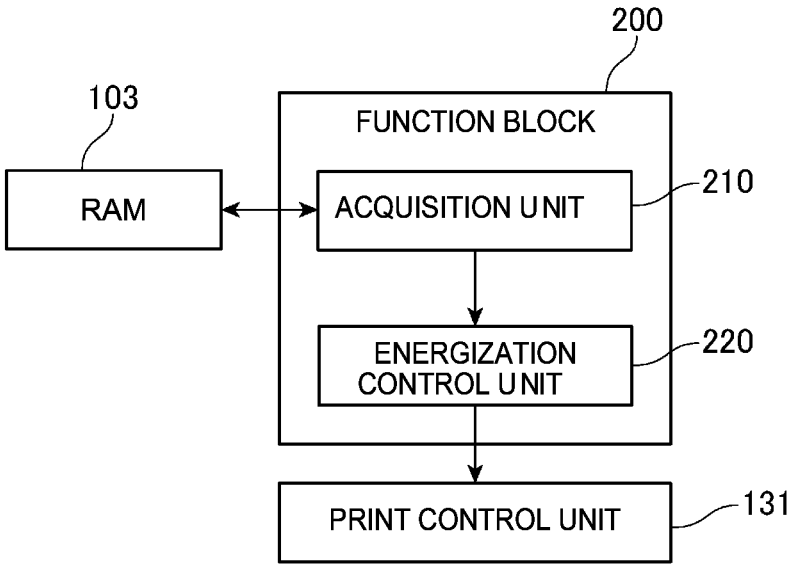
FIG. 3 is a block diagram of an exemplary configuration of the function blocks of a control device.

An example of the configuration of function block 200 of the control device 100 is described next with reference to FIG. 3. This function block 200 is a block of the individual functions embodied by a sequence of processes that are executed by the cooperation of software and hardware, such as the control programs and the CPU 101 and RAM 103 of the control device 100. The function blocks 200 of the control device 100 in this embodiment include an acquisition unit 210 and an energization control unit 220.

To print a line, the acquisition unit 210 reads the image data of the next line to be printed after the target line that is printed first, and acquires the information of the pixels that form the image during line printing of said next line. More specifically, the acquisition unit 210 accesses the image buffer in the RAM 103 and acquires the information of the pixels that form the image during line printing of the next line.

When using line printing to print one line, the energization control unit 220 energizes the heat elements 1326 that are to form image dots with the amount of energy required to form the image based on the image data of the target line in a dot-forming energization step. After dot-forming energization, the energization control unit 220 executes a read-ahead energization step that energizes the heat elements 1326 corresponding to the pixels acquired by the acquisition unit 210 enough to increase the heat output of the heat elements 1326 without forming an image. The energization control unit 220 controls energization by adjusting the strobe signal STB output to the print control unit 131. The energization control unit 220 controls energizing by controlling the time the strobe signal STB is active. Dots are formed and images are printed on thermal paper by the heat applied to the recording paper. By controlling the energizing time of the heat elements 1326, the thermal printer 1 controls how much the heat elements 1326 are energized, that is, the heat output, and forms an image on the recording paper.

The hysteresis energization control method of the related art is described first below before describing a specific example of the process executed by the acquisition unit 210 and energization control unit 220 of at least one embodiment of the present invention. Hysteresis energization control is a method of preheating the heat elements 1326 before actually printing the line being processed based on whether or not there was previous image data for particular heat elements 1326. If the temperature of the heat element 1326 is low, the dot formed by that heat element 1326 will be small or light, and print quality suffers. As a result, if a dot is not formed for a particular pixel on the line before the target line selected for processing, but a dot is formed on the target line at that pixel, the heat element 1326 corresponding to that pixel is energized before dot formation.

Figure 4:
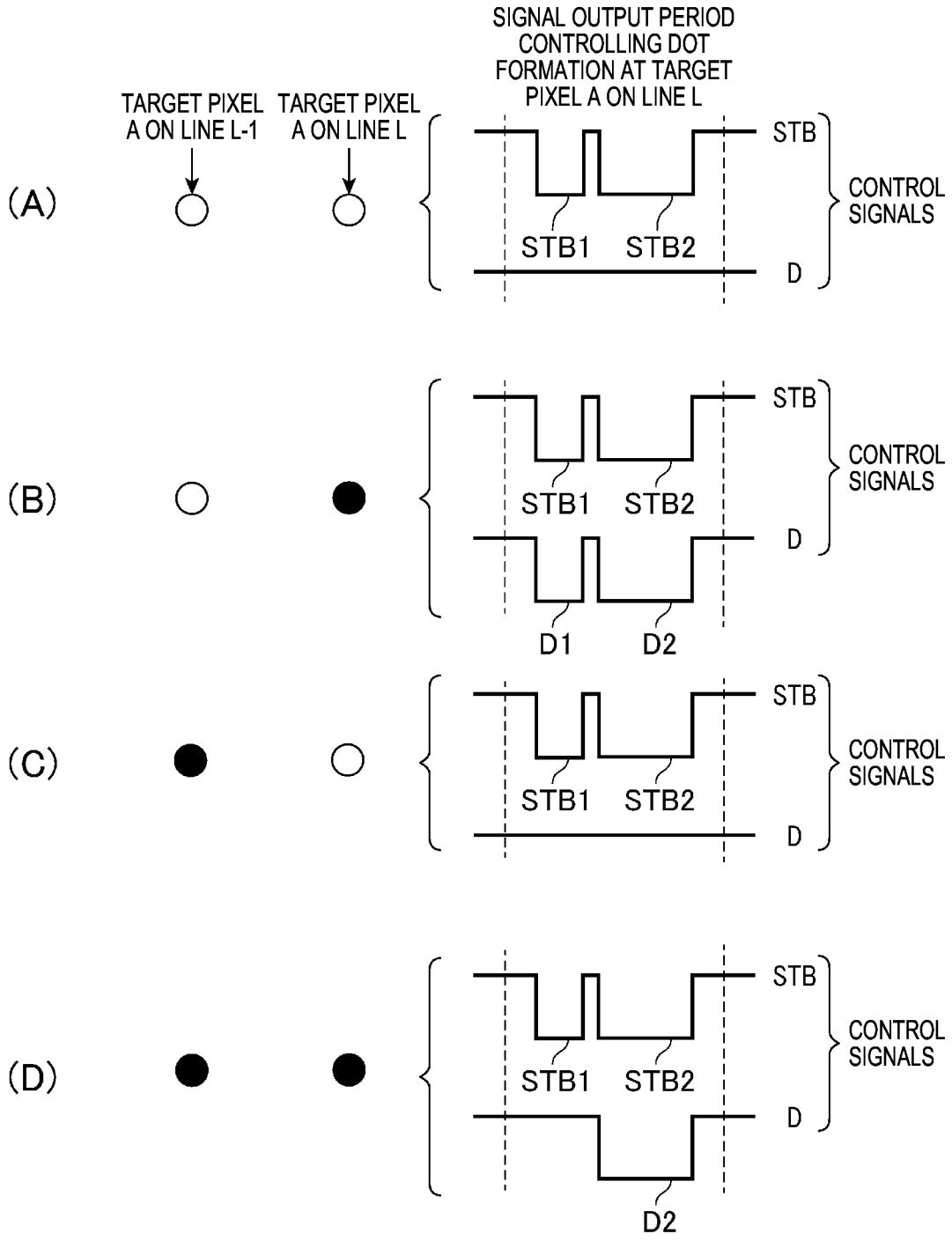
FIG. 4 is used to describe a method of the related art for controlling energizing heat elements using hysteresis.

Hysteresis control of energizing is further described below with reference to FIG. 4. FIG. 4 (A) to (D) illustrate dot formation of the target pixel A on line L, which is the target line, and the target pixel A on line L−1, which is one line before line L. Examples of the control signals input to the thermal head 132 for dot formation at target pixel A on line L are shown in FIG. 4 (A) to (D). Time is shown on the x-axis, and the period between the two vertical dotted lines is the printing period of line L. Note that the white dots shown in FIG. 4 (A) to (D) represent pixels where the target pixel A does not form a dot (that is, white pixels in this example), and the black dots represent pixels where the target pixel A forms a dot (that is, a black dot).

In the examples shown in FIG. 4 (A) to (D), the data signal D and the strobe signal STB are shown as control signals. In the example shown in FIG. 4, the strobe signal STB and data signal D are signals that are active when the signal level is low. The strobe signal STB is always output with either a high or low signal level, and the strobe signal STB is said to be output when the signal level of the strobe signal STB goes low and the signal is active. For example, saying that the strobe signal STB is output means that the signal level of the strobe signal STB changed from high to low. This also applies to the data signal D, and saying the data signal D was output means that the signal level of the data signal D went low and the signal is active.

Figure 5:
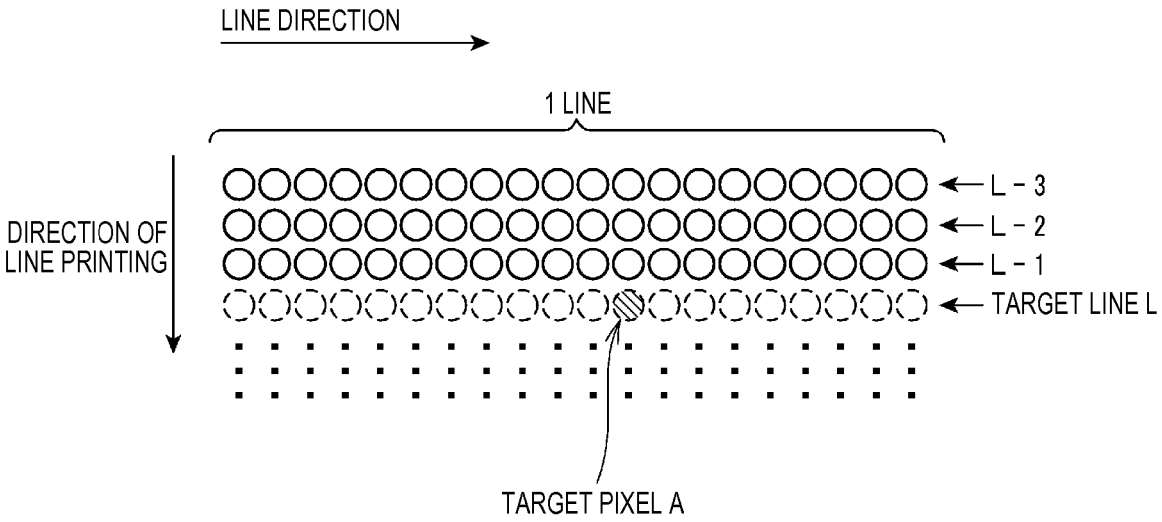
FIG. 5 is used to describe a target line and a target pixel.

The target line denotes the line that is printed next by the thermal head 132 by line printing. FIG. 5 schematically illustrates the target line and the target pixel on the recording paper. In FIG. 4, line printing proceeds in the sequence line L−3, line L−2, and line L−1, and line L, which is the line that is printed next, is the target line. A target pixel is any one pixel in the pixels on the target line that is targeted by the operation described below.

FIG. 4 (A) shows an example in which a target pixel A is not formed on line L−1 or line L. In this event, a strobe signal STB set to the active signal level is input to the thermal head 132, but the data signal D remains at the inactive signal level. The strobe signal STB is a signal that sets the time a heat element 1326 is energized, and is a signal that is common to all heat elements 1326. As a result, the strobe signal STB is output to the switch circuit 1323 for all pixels at a specific timing regardless of whether a particular pixel forms a dot or the pixel does not form a dot. In the example shown in FIG. 4 (A), two strobe signals STB, strobe signal STB1 and strobe signal STB2, are output during the signal output period that controls dot formation at target pixel A on line L.

The first strobe signal STB1 is a signal that is output at the hysteresis energization timing. More specifically, strobe signal STB1 is output at the hysteresis energization timing for warming a heat element before dot-forming energization to forma dot. The second strobe signal STB2 is a signal that is output at the dot-forming energization timing to form a dot on the recording paper.

Note that because the data signal D is not input to the thermal head 132 in the example shown in FIG. 4 (A), a dot corresponding to target pixel A will be not be formed on the recording paper even if the strobe signal STB is input to the thermal head 132 FIG. 4 (B) shows an example in which a dot is not formed at target pixel A on line L−1, but is formed at target pixel A on line L. To form a dot at target pixel A on line L in this event, both a strobe signal STB and a data signal D with an active signal level are input to the thermal head 132. In the example shown in FIG. 4 (B), two data signals D, data signal D1 and data signal D2, are input to the thermal head 132 during the signal output period that controls dot formation at target pixel A on line L. The strobe signals STB in the example in FIG. 4 (A), that is, strobe signal STB1 and strobe signal STB2, are also input to the thermal head 132. The first data signal D1 is a signal that is set active for hysteresis energization. A dot is not formed at target pixel A on line L−1, which is the line preceding line L. As a result, data signal D1 is output to preheat the heat element 1326 forming the dot at target pixel A before outputting data signal D2 for dot-forming energization. The heat element 1326 is energized and heats as a result of inputting data signal D1 to the thermal head 132 synchronized to the strobe signal STB1.

FIG. 4 (C) shows an example in which a dot is formed at target pixel A on line L−1, and a dot is not formed at target pixel A on line L. In this case, both strobe signal STB1 and strobe signal STB2 are input to the thermal head 132, but the data signal D is not input to the thermal head 132.

FIG. 4 (D) shows an example in which a dot is formed at target pixel A on line L after forming a dot at target pixel A on line L−1. Because a dot is formed at target pixel A on line L−1 in this case, heat element 1326 that forms the dot at target pixel A is energized to print on line L−1 and is thereby preheated. There is therefore no need to preheat that heat element 1326, the data signal D1 is not output at the hysteresis energization timing, and data signal D2 is output at the dot-forming energization timing.

Energization control applied by the control device 100 according to this embodiment is described next with reference to FIG. 6. Note that energization control is accomplished by processes executed by acquisition unit 210 and energization control unit 220 function blocks shown in FIG. 3. However, energization control is described below as a process of the control device 100 instead of being split into a process of the acquisition unit 210 and a process of the energization control unit 220. The control device 100 according to this embodiment controls warming the heat element 1326 (referred to below as read-ahead energization) after line printing the target line according to the line printing state of the next line after the target line being processed.

Figure 6:
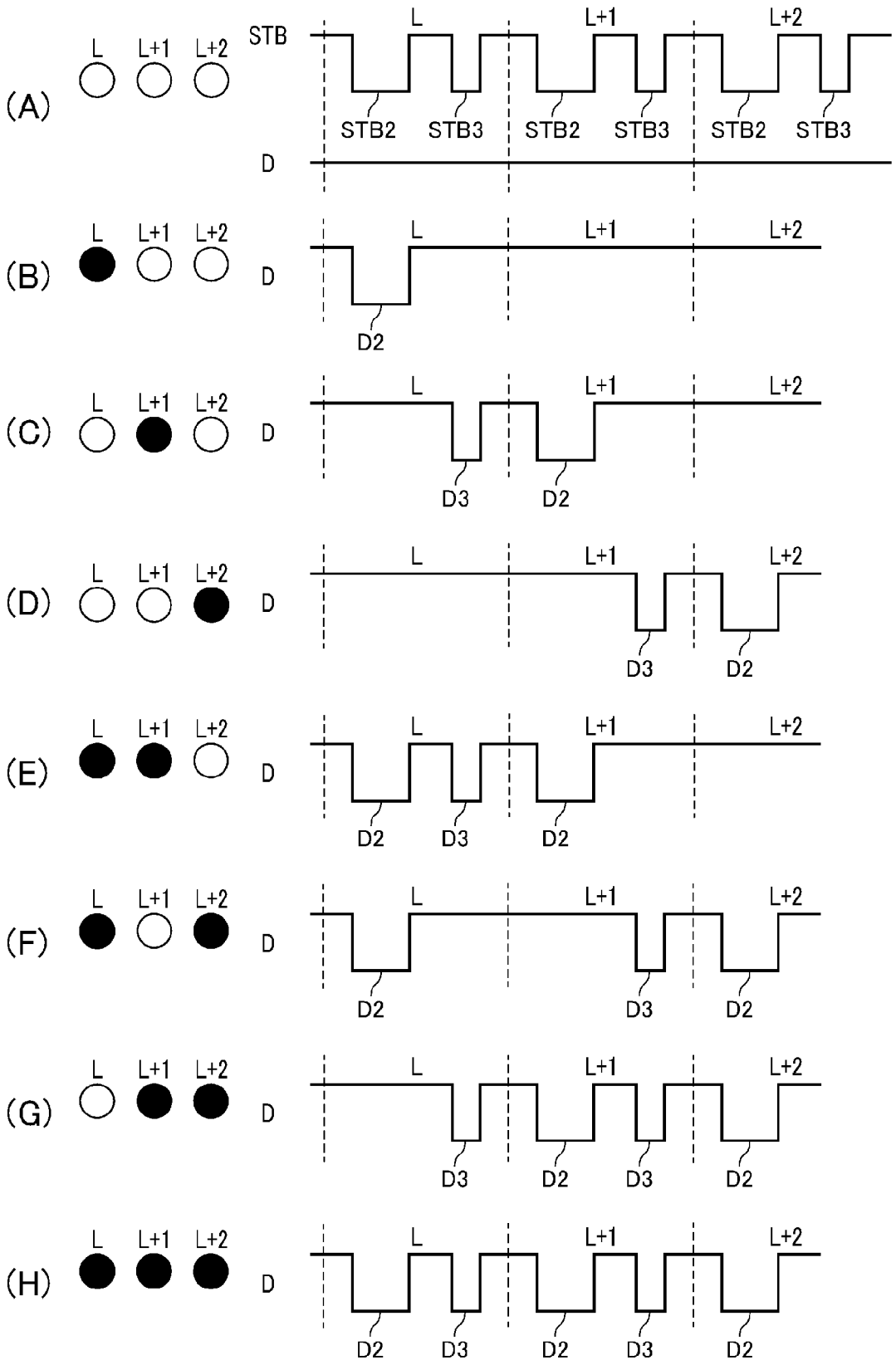
FIG. 6 is used to describe the control method of a control device according to some embodiments.

FIG. 6 illustrates dot formation of the target pixel A on three lines, first line L, second line L+1, and third line L+2. As described in FIG. 4, the white dots represent pixels where the target pixel A does not form a dot (that is, white dots (does not print)), and the black dots represent pixels where the target pixel A forms a dot (that is, a black dot (prints)). Examples of the control signals the control device 100 outputs to the thermal head 132 to form a dot at target pixel A on lines L, L+1, and L+2 are shown in FIG. 6. The x-axis denotes time, and the spaces between one dotted line and the next dotted line are the printing periods of line L and line L+1. The print unit 130 prints line by line in the order first line L, second line L+1, and third line L+2. Each of these continuously printed lines then corresponds to a first line printing step or a second printing step. Target pixel A is a pixel where a dot is formed on first line L, second line L+1, or third line L+2 by the same heat element 1326 in the group of plural heat elements 1326 arrayed in a line. Data signal D and the strobe signal STB are shown as control signals in FIG. 6 (A), but because the strobe signal STB always has the same signal waveform regardless of the image data for target pixel A, the strobe signal STB is not shown in FIG. 6 (B) to (H). In the example shown in FIG. 6, the strobe signal STB and data signal D are signals that are active when the signal level goes low. The strobe signal STB is in the output state when the signal level of the strobe signal STB is active. The same applies to the data signal D. The target line and the target pixel A are also as described with reference to FIG. 5.

In the example shown in FIG. 6, an energizing period (first energizing period) of dot-forming energization that forms a dot is defined by strobe signal STB2, and the energizing period (second energizing period) of dot-forming energization that forms a dot is defined by strobe signal STB3, in the printing period. In this example, the control device 100 outputs the strobe signal STB2 that defines the dot formation energizing period to the print unit 130, and then outputs the strobe signal STB3 that defines the energizing period for read-ahead energization to the print unit 130. The output period of strobe signal STB3 is also shorter than the output period of strobe signal STB2. More specifically, the energizing period for read-ahead energization is shorter than the energizing period for dot formation. This is because read-ahead energization does not form a dot, and energizes only sufficiently to increase the heat output of the addressed heat element. For example, the energizing period for read-ahead energization is less than or equal to half (½) the energizing period for dot formation.

FIG. 6 (A) shows an example in which a dot is not formed at target pixel A on the first line L, the second line L+1, or the third line L+2. In this case, the control device 100 outputs strobe signal STB2 and strobe signal STB3 to the print unit 130 during the output period of the control signals for the first line L, but does not output the data signal D to the print unit 130. Likewise in the output period of the control signals for the second line L+1 and the third line L+2, the control device 100 outputs strobe signal STB2 and strobe signal STB3 to the print unit 130, but does not output the data signal D to the print unit 130.

FIG. 6 (B) shows an example in which a dot is formed at target pixel A on the first line L, and a dot is not formed at target pixel A on the second line L+1 and third line L+2.

The operation of the control device 100 in the output period of signals that control dot formation on the first line L when the first line L is the target line is described next. When generating the control signals for target pixel A on the first line L, the control device 100 references the image data for target pixel A on the first line L, and target pixel A on the second line L+1, which is the next line after the first line L. The target pixel A on the first line L is a pixel where a dot is formed, and the target pixel A on the second line L+1 is a pixel where a dot is not formed. As a result, the control device 100 outputs data signal D2 according to the timing when the strobe signal STB2 is output in the output period of the control signals for the first line L. Note that this data signal D2 is a signal output from the control device 100 to the print unit 130 at the dot-forming energization timing. The target pixel A on the second line L+1 is a pixel where a dot is not formed. As a result, the control device 100 does not output data signal D3 at the time when the strobe signal STB3 is output in the output period of the control signals for the first line L. Note that the data signal D3 is the signal output from the control device 100 to the print unit 130 at the timing for read-ahead energization.

The operation of the control device 100 in the output period of signals that control line printing of the second line L+1 when the second line L+1 is the target line is described next. When generating the control signals for target pixel A on the second line L+1, the control device 100 references the image data for target pixel A on the second line L+1, and target pixel A on the third line L+2, which is the next line after the second line L+1. The target pixel A on the second line L+1 is a pixel where a dot is not formed, and the target pixel A on the third line L+2 is also a pixel where a dot is not formed. As a result, the control device 100 does not output data signal D2 at the time when the strobe signal STB2 is output in the output period of the control signals for the second line L+1. Note that the control device 100 does not output data signal D3 at the timing for outputting the strobe signal STB3 in the output period of the control signals for the second line L+1.

FIG. 6 (C) shows an example in which a dot is formed at target pixel A on the second line L+1, and a dot is not formed at target pixel A on the first line L and third line L+2.

The operation of the control device 100 in the output period of signals that control line printing on the first line L when the first line L is the target line is described next. The control device 100 references the image data for target pixel A on the first line L, and target pixel A on the second line L+1. The target pixel A on the first line L is a pixel where a dot is not formed, and the target pixel A on the second line L+1 is a pixel where a dot is formed. As a result, the control device 100 does not output data signal D2 at the timing when the strobe signal STB2 is output in the output period of the control signals for the first line L. The target pixel A on the second line L+1 is a pixel where a dot is formed. As a result, the control device 100 outputs data signal D3 to the print unit 130 at the output timing of the strobe signal STB3 in the output period of the control signals for the first line L.

The operation of the control device 100 in the output period of signals that control line printing of the second line L+1 when the second line L+1 is the target line is described next. The control device 100 references the image data for target pixel A on the second line L+1, and target pixel A on the third line L+2. The target pixel A on the second line L+1 is a pixel where a dot is formed, and the target pixel A on the third line L+2 is a pixel where a dot is not formed. As a result, the control device 100 outputs data signal D2 at the output timing of the strobe signal STB2 in the output period of the control signals for the second line L+1. The control device 100 does not output data signal D3 at the timing for outputting the strobe signal STB3 in the output period of the control signals for the second line L+1.

FIG. 6 (D) shows an example in which a dot is formed at target pixel A on the third line L+2, and a dot is not formed at target pixel A on the first line L and second line L+1.

The operation of the control device 100 in the output period of signals that control line printing on the first line L when the first line L is the target line is described next. The control device 100 references the image data for target pixel A on the first line L, and target pixel A on the second line L+1. In this example, a dot is not formed at the target pixel A on the first line L or the second line L+1. As a result, the control device 100 does not output data signal D2 to the print unit 130 at the timing when the strobe signal STB2 is output in the output period of the control signals for the first line L. The control device 100 also does not output data signal D3 to the print unit 130 at the timing when the strobe signal STB3 is output in the output period of the control signals for the first line L.

The operation of the control device 100 in the output period of signals that control line printing of the second line L+1 when the second line L+1 is the target line is described next. The control device 100 references the image data for target pixel A on the second line L+1, and target pixel A on the third line L+2. The target pixel A on the second line L+1 is a pixel where a dot is not formed, and the target pixel A on the third line L+2 is a pixel where a dot is formed. As a result, the control device 100 does not output data signal D2 at the output timing of the strobe signal STB2 in the output period of the control signals for the second line L+1. The control device 100 outputs data signal D3 at the timing for outputting the strobe signal STB3 in the output period of the control signals for the second line L+1.

FIG. 6 (E) shows an example in which a dot is formed at target pixel A on the first line L and the second line L+1, and a dot is not formed at target pixel A on the third line L+2.

The operation of the control device 100 in the output period of signals that control line printing on the first line L when the first line L is the target line is described next. The control device 100 references the image data for target pixel A on the first line L, and target pixel A on the second line L+1. A dot is formed at the target pixel A on both the first line L and the second line L+1 in this example. As a result, the control device 100 outputs data signal D2 at the timing when the strobe signal STB2 is output in the output period of the control signals for the first line L. The control device 100 also outputs data signal D2 at the timing when the strobe signal STB2 is output in the output period of the control signals for the first line L. The control device 100 also outputs data signal D3 to the print unit 130 at the timing when the strobe signal STB3 is output in the output period of the control signals for the first line L.

The operation of the control device 100 in the output period of signals that control line printing of the second line L+1 when the second line L+1 is the target line is described next. The control device 100 references the image data for target pixel A on the second line L+1, and target pixel A on the third line L+2. The target pixel A on the second line L+1 is a pixel where a dot is formed, and the target pixel A on the third line L+2 is a pixel where a dot is not formed. As a result, the control device 100 outputs data signal D2 at the output timing of the strobe signal STB2 in the output period of the control signals for the second line L+1. The control device 100 does not output data signal D3 at the timing for outputting the strobe signal STB3 in the output period of the control signals for the second line L+1.

FIG. 6 (F) shows an example in which a dot is formed at target pixel A on the first line L and third line L+2, and a dot is not formed at target pixel A on the second line L+1.

The operation of the control device 100 in the output period of signals that control line printing on the first line L when the first line L is the target line is described next. The control device 100 references the image data for target pixel A on the first line L, and target pixel A on the second line L+1. The target pixel A on the first line L is a pixel where a dot is formed, and the target pixel A on the second line L+1 is a pixel where a dot is not formed. As a result, the control device 100 outputs data signal D2 to the print unit 130 at the timing when the strobe signal STB2 is output in the output period of the control signals for the first line L. The control device 100 does not output data signal D3 to the print unit 130 at the timing when the strobe signal STB3 is output in the output period of the control signals for the first line L.

The operation of the control device 100 in the output period of signals that control line printing of the second line L+1 when the second line L+1 is the target line is described next. The control device 100 references the image data for target pixel A on the second line L+1, and target pixel A on the third line L+2. The target pixel A on the second line L+1 is a pixel where a dot is not formed, and the target pixel A on the third line L+2 is a pixel where a dot is formed. As a result, the control device 100 does not output data signal D2 to the print unit 130 at the output timing of the strobe signal STB2 in the output period of the control signals for the second line L+1. The control device 100 outputs data signal D3 at the timing for outputting the strobe signal STB3 in the output period of the control signals for the second line L+1.

FIG. 6 (G) shows an example in which a dot is formed at target pixel A on the second line L+1 and the third line L+2, and a dot is not formed at target pixel A on the first line L.

The operation of the control device 100 in the output period of signals that control line printing on the first line L when the first line L is the target line is described next. The control device 100 references the image data for target pixel A on the first line L, and target pixel A on the second line L+1. The target pixel A on the first line L is a pixel where a dot is not formed, and the target pixel A on the second line L+1 is a pixel where a dot is formed. As a result, the control device 100 does not output data signal D2 to the print unit 130 at the timing when the strobe signal STB2 is output in the output period of the control signals for the first line L. The control device 100 outputs data signal D3 to the print unit 130 at the timing when the strobe signal STB3 is output in the output period of the control signals for the first line L.

The operation of the control device 100 in the output period of signals that control line printing of the second line L+1 when the second line L+1 is the target line is described next. The control device 100 references image data for the target pixel A on the second line L+1 and the target pixel A on the third line L+2. The target pixel A on the second line L+1 is a pixel where a dot is formed. As a result, the control device 100 outputs data signal D2 to the print unit 130 at the output timing of the strobe signal STB2 in the output period of the control signals for the second line L+1. The control device 100 also outputs data signal D3 to the print unit 130 at the output timing of the strobe signal STB3 in the output period of the control signals for the second line L+1.

FIG. 6 (H) shows an example in which a dot is formed at target pixel A on the first line L, the second line L+1, and the third line L+2.

The operation of the control device 100 in the output period of signals that control line printing on the first line L when the first line L is the target line is described next. The control device 100 references the image data for target pixel A on the first line L, and target pixel A on the second line L+1. In this example, the target pixel A on the first line L is a pixel where a dot is formed, and the target pixel A on the second line L+1 is also a pixel where a dot is formed. As a result, the control device 100 outputs data signal D2 at the timing when the strobe signal STB2 is output in the output period of the control signals for the first line L. The control device 100 also outputs data signal D3 at the timing when the strobe signal STB3 is output in the output period of the control signals for the first line L. Note that the control signals for target pixel A on the second line L+1 and the third line L+2 are the same as the control signals for the target pixel A on the first line L, and further description thereof is thus omitted.

Figure 7:
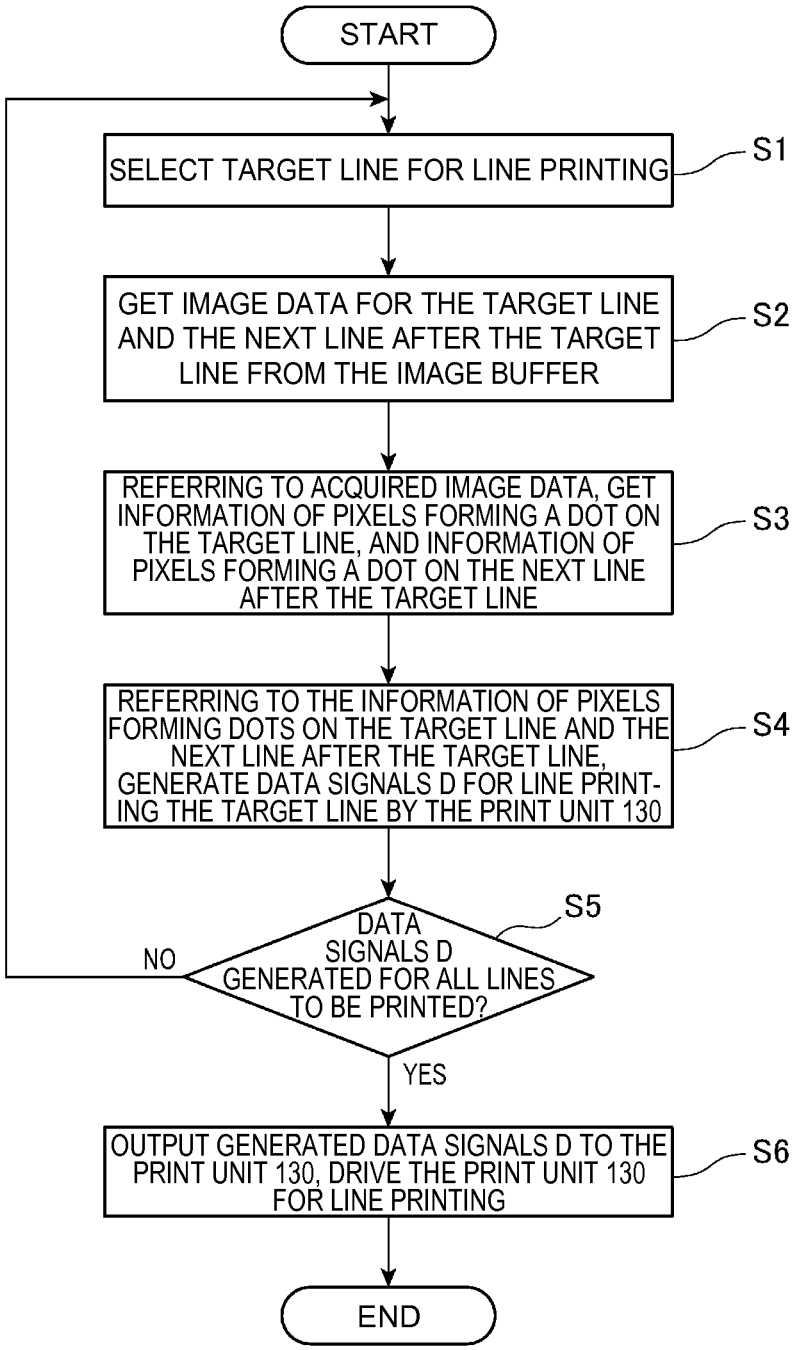
FIG. 7 is a flow chart illustrating steps in the control method of the control device.

Operation of the control device 100 is described next with reference to the flow chart in FIG. 7.

The control device 100 first selects the target line for line printing (step S1). Next, the control device 100 reads the image data for the selected target line and the line to be line printed next after the target line from the image buffer in RAM 103 (step S2). Next, the control device 100 gets the information for the pixels where a dot is formed on the target line, and information for pixels where a dot is formed on the next line after the target line, by referring to the image data acquired from the image buffer (step S3). Next, the control device 100 generates the data signals D controlling line printing the target line by the print unit 130 based on the pixel information for dot formation on the target line and the next line after the target line (step S4). The data signals D are signals causing dot-forming energization of the heat elements 1326 corresponding to the pixels where a dot is formed on the target line, and read-ahead energization of the heat elements 1326 corresponding to the pixels where a dot is formed on the next line after the target line.

Next, the control device 100 determines if data signals D were generated for every single line (all lines) to be line printed (step S5). If data signals D have not be generated for all lines (step S5 returns NO), the control device 100 returns to step S1 and repeats the process from step S1 to step S5. If data signals D have been generated for all lines (step S5 returns YES), the control device 100 outputs the generated data signals D with the strobe signal STB and clock signal CLK to the print unit 130 (step S6).

The print unit 130 accumulates the data signals D input from the control device 100 in the shift register 1321 of the thermal head 132. The data signals D accumulated in the shift register 1321 are output to the latch register 1322 synchronized to the latch signals output from the print control unit 131. The NAND gates 1324 of the switch circuit 1323 perform a NAND operation on the corresponding data signal D output from the latch register 1322 and the signal resulting from a NOT operation on the strobe signal STB. The corresponding heat element 1326 is energized according to the output from the NAND gate 1324 of the switch circuit 1323, and the energized heat element 1326 heats.

As described above, some embodiments of the invention generates control signals that control line printing of a target line, and control signals that energize the heat elements 1326 corresponding to the pixels where a dot is formed on the next line after the target line. The control signals that control line printing of a target line, and the control signals that energize the heat elements 1326 corresponding to the pixels where a dot is formed on the next line are then sequentially output to the print unit 130 during the output period of control signals for the target line. As a result, energizing the heat elements on the line to be line printed next can be controlled based on the image data of the line one line after the line that is line printed next. A drop in print quality resulting from the temperature of heat elements 1326 being low during line printing and the formed dots being small or light can therefore be suppressed.

Because the heat elements 1326 for pixels that form a dot on the next line after the target line can be heated immediately after the end of the dot-forming energization period, a temperature drop in the heat element 1326 can be prevented. Compared with hysteresis energization that warms a heat element 1326 immediately before dot-forming energization, the energizing time of the heat element 1326 can therefore be shortened and power consumption can be reduced.

Figure 8:
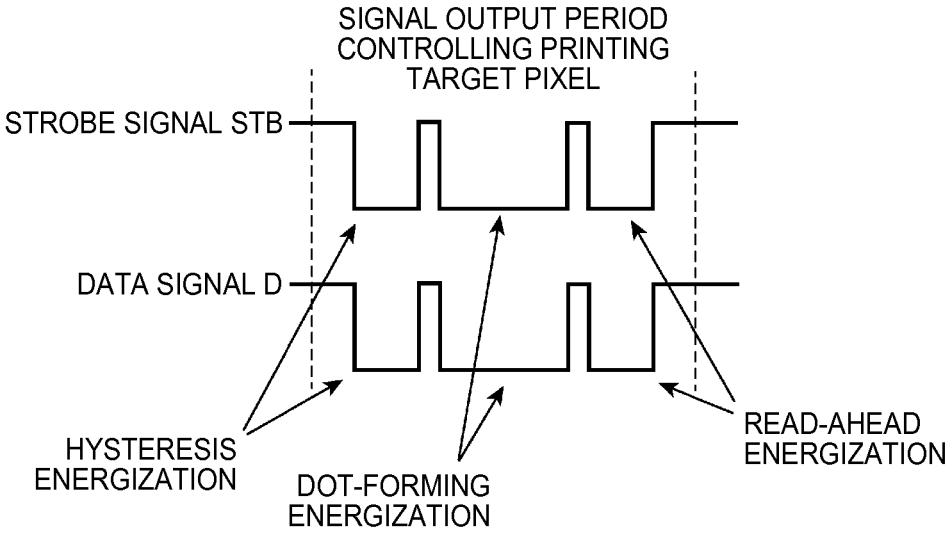
FIG. 8 illustrates controlling energizing heat elements using a combination of hysteresis and read-ahead energization control.

The number of times a heat element 1326 is energized to form a dot using a combination of hysteresis energization and read-ahead energization may conceivably be divided into three parts, hysteresis energization, dot-forming energization, and read-ahead energization, as shown in FIG. 8. More particularly, the control device 100 outputs the strobe signal STB three times to the thermal head 132 to form a dot. When the strobe signal STB is output three times, the strobe signal STB is output one more time than when controlling energizing based on read-ahead energization. As a result, the dot formation period of one dot becomes longer, and the need for a faster printing speed cannot be met.

In contrast, some embodiments of the invention energizes the heat element 1326 for an energizing time that does not form a dot on the recording paper after energizing the heat element 1326 to form a dot (dot-forming energization) during the heat element 1326 energizing period that forms a dot. As a result, a temperature drop in the heat element 1326 after dot-forming energization can be prevented, and hysteresis energization before dot-forming energization is unnecessary. A temperature drop in the heat element 1326 can therefore be prevented, and a drop in print quality can be prevented. In addition, because the strobe signal STB is output only twice to form one dot, a faster printing speed can also be achieved.

As described above, the control device 100 according to some embodiments of the invention is a control device 100 of a thermal head 132 having a plurality of heat elements 1326 arrayed in a line. The control device 100 has a acquisition unit 210 and a energization control unit 220. The acquisition unit 210 acquires information of the pixels where a dot is formed during line printing of a second line during continuous line printing of a first line and the second line by the plural heat elements 1326. The energization control unit 220 controls energizing the heat elements 1326 in the first energizing period of a printing period of the first line based on the image data used to print the first line, and controls energizing the heat elements during the second energizing period of the printing period based on the image data for printing the first line and the pixel information acquired by the acquisition unit 210.

When printing a first line, the control device 100 thus comprised controls energizing the heat elements 1326 that are to form a dot when printing the first line during the first energizing period, and controls energizing the heat elements 1326 corresponding to the pixels that form dots on the second line sufficiently to increase the temperature of the heat elements 1326 during the second energizing period of the printing period without forming a dot. The heat output of the heat elements 1326 corresponding to pixels that form a dot on when printing the second line can therefore be increased when printing the first line. A drop in print quality due to the temperature of the heat element 1326 being low when printing and the formed dot being small or light can therefore be suppressed.

The second energizing period is less than or equal to ½ the first energizing period. This enables controlling selected heat elements 1326 to form a dot during the first energizing period, and controlling the temperature of other heat elements 1326 without forming a dot in the second energizing period, when printing the first line.

Energizing in the first energizing period is dot-forming energization of an amount that forms a dot, and energizing in the second energizing period is read-ahead energization of an amount that increases the temperature of a heat element without forming a dot. Therefore, the heat output of the heat elements 1326 corresponding to the pixels that form dots when printing the second line can be increased without forming a dot when printing the first line. As a result, a drop in print quality due to the temperature of the heat element 1326 being low when printing and the formed dot being small or light can therefore be suppressed.

The energization control unit 220 controls the amount the heat element 1326 is energized by controlling the energizing time, and the energizing time of the read-ahead energization is shorter than the energizing time for dot-forming energization. Therefore, because energization of the heat element 1326 is controlled by the energizing time, controlling how much the heat elements 1326 are energized is simple. In addition, because the energizing time of read-ahead energization is shorter than the energizing time of dot-forming energization, heat output of dots to which read-ahead energization is applied is less than the heat output of dots to which dot-forming energization is applied. As a result, the temperature of heat elements 1326 to which read-ahead energization is applied can be increased to a temperature lower than the temperature required to form a dot.

Based on image data for printing the second line, the energization control unit 220 drives the heat elements 1326 that form a dot and print black on the second line at the read-ahead energization level, and does not drive the heat elements 1326 that form a white dot and do not form a dot on the second line at the read-ahead energization level. The heat elements 1326 that form a dot and print a black image when printing the second line can therefore be energized when printing the first line. As a result, a drop in print quality due to the temperature of the heat elements 1326 that form a dot when printing the second line being low and the formed dots being small or light can therefore be suppressed.

Some embodiments of the invention being thus described, it will be obvious that it may be varied in many ways. Such variations are not to be regarded as a departure from the spirit and scope of the disclosure, and all such modifications as would be apparent to one skilled in the art are intended to be included within the scope of the following claims.

What is claimed is:

1. A control device of a thermal head having a plurality of heat elements arranged in a line, comprising:

an acquisition unit that acquires information of pixels forming dots when printing a second line during line printing of a first line and the second line by continuous line printing by the plural heat elements, a printing period of the first line including a first energizing period and a second energizing period; and an energization control unit that controls energizing the heat elements during the first energizing period based on image data related to printing the first line, and controls energizing the heat elements in the second energizing period based on the image data related to printing the first line and the pixel information acquired by the acquisition unit.

2. The control device described in claim 1, wherein:

the second energizing period is less than or equal to ½ the first energizing period.

3. The control device described in claim 1, wherein:

the acquisition unit references image data related to printing the second line and acquires information of a pixel forming a dot when printing the second line during line printing by the plural heat elements; and the energization control unit applies dot-forming energization that forms dots to the heat elements based on the image data related to printing the first line in the first energizing period, and applies read-ahead energization to the heat elements in the second energizing period after the dot-forming energization.

4. The control device described in claim 3, wherein:

the dot-forming energization is energizing of an amount that forms a dot; and the read-ahead energization is energizing of an amount that increases heat output without forming a dot.

5. The control device described in claim 4, wherein:

the energization control unit controls how much the heat element is energized by the energizing time, and the energizing time of read-ahead energization is shorter than the energizing time of the dot-forming energization.

6. The control device described in claim 3, wherein:

based on image data related to printing the second line, the energization control unit energizes by read-ahead energization the heat elements that form a dot and form a black image on the second line, and does not energize by read-ahead energization the heat elements that do not form a dot and form a white image on the second line.

7. A printer comprising:

the control device described in claim 1; and a thermal head having a plurality of heat elements arranged in a line.

8. A control method of a printer that is a control device of a thermal head having a plurality of heat elements arranged in a line, comprising:

acquiring information of pixels forming dots when printing a second line during line printing of a first line and the second line by continuous line printing by the plural heat elements, a printing period of the first line including a first energizing period and a second energizing period; and controlling energizing the heat elements in the first energizing period based on image data related to printing the first line, and controlling energizing the heat elements in the second energizing period based on the image data related to printing the first line and the acquired pixel information.

9. The control method of a printer described in claim 8, wherein:

the second energizing period is less than or equal to ½ the first energizing period.

10. The control method of a printer described in claim 8, further comprising:

referencing image data related to printing the second line and acquiring information of a pixel forming a dot when printing the second line during line printing by the plural heat elements; and applying dot-forming energization that forms dots to the heat elements based on the image data related to printing the first line in the first energizing period, and applying read-ahead energization to the heat elements in the second energizing period after the dot-forming energization.

11. The control method of a printer described in claim 10, wherein:

the dot-forming energization is energizing of an amount that forms a dot; and the read-ahead energization is energizing of an amount that increases heat output without forming a dot.

12. The control method of a printer described in claim 11, wherein:

how much the heat element is energized is controlled by the energizing time, and the energizing time of read-ahead energization is shorter than the energizing time of the dot-forming energization.

13. The control method of a printer described in claim 10, further comprising:

energizing by read-ahead energization the heat elements that form a dot and form a black image on the second line, and not energizing by read-ahead energization the heat elements that do not form a dot and form a white image on the second line, based on image data related to printing the second line.

* * * * *